US006603449B1

(12) United States Patent
Kang et al.

(10) Patent No.: US 6,603,449 B1
(45) Date of Patent: Aug. 5, 2003

(54) METHOD OF ADDRESSING PLASMA PANEL WITH ADDRESINGPULSES OF VARIABLE WIDTHS

(75) Inventors: Kyoung-ho Kang, Asan (KR); Jeong-duk Ryeom, Cheonan (KR); Seong-charn Lee, Seoul (KR)

(73) Assignee: Samsung SDI Co., Ltd., Kyungki-Do (KR)

( * ) Notice: Subject to any disclaimer, the term of this patent is extended or adjusted under 35 U.S.C. 154(b) by 289 days.

(21) Appl. No.: 09/692,167

(22) Filed: Oct. 20, 2000

(30) Foreign Application Priority Data

Nov. 10, 1999 (KR) ..... 1999-49712

(51) Int. Cl.[7] ..... G09G 3/28
(52) U.S. Cl. ..... 345/67; 345/63; 345/66
(58) Field of Search ..... 345/60–72, 690, 345/691, 692, 693; 315/169.1, 169.4

(56) References Cited

U.S. PATENT DOCUMENTS 6,037,916 A * 3/2000 Amemiya ..... 345/60
6,150,766 A * 11/2000 Shino et al. ..... 315/169.4
6,340,961 B1 * 1/2002 Tanaka et al. ..... 345/63
6,404,411 B1 * 6/2002 Masuda et al. ..... 345/66

* cited by examiner

*Primary Examiner*—Steven Saras
*Assistant Examiner*—Amr Awad
(74) *Attorney, Agent, or Firm*—Leydig, Voit & Mayer, Ltd.

(57) ABSTRACT

A method for driving a plasma display panel having front and rear substrates opposed to and facing each other, X and Y electrode lines between the front and rear substrates parallel to each other, and address electrode lines orthogonal to the X and Y electrode lines, to define corresponding pixels at intersections, the method including applying scan pulses to respective groups of Y electrode lines with a time difference and simultaneously applying corresponding display data signals to respective address electrode lines to form wall charges at pixels where a display discharge is to occur, and alternately applying pulses for a display discharge to the X and Y electrode lines to cause a display discharge at the pixels where wall charges have been formed, wherein, as a time difference between (i) a first pulse of the pulses for display discharges, and (ii) pulses of the display data signals applied to pixels for a display discharge before application of the first pulse becomes larger, widths of the pulses of the display data signals applied to pixels where a display is to occur and of corresponding scan pulses are increased.

1 Claim, 5 Drawing Sheets

METHOD OF ADDRESSING PLASMA PANEL WITH ADDRESINGPULSES OF VARIABLE WIDTHS

BACKGROUND OF THE INVENTION

1. Field of the Invention

The present invention relates to a method for driving a plasma display panel, and more particularly, to a method for driving a three-electrode surface-discharge FIG. 1, and FIG. 3 show an example of a pixel of the panel shown in FIG. 1 plasma display panel.

2. Description of the Related Art

FIG. 1 shows a structure of a general three-electrode surface-discharge plasma display panel, FIG. 2 shows an electrode line pattern of the panel shown in FIG. 1, and FIG. 3 show an example of a pixel of the panel shoen in FIG. 1. Referring to the drawings, address electrode lines $A_1, A_2, \ldots A_m$, dielectric layers 11 and 15, Y electrode lines $Y_1, Y_2, \ldots Y_n$, X electrode lines $X_1, X_2, \ldots X_n$, phosphors 16, partition walls 17 and a MgO protective film 12 are provided between front and rear glass substrates 10 and 13 of a general surface-discharge plasma display panel 1.

The address electrode lines $A_1, A_2, \ldots A_m$ are provided on the front surface of the rear glass substrate 13 in a predetermined pattern. The lower dielectric layer 15 covers the entire front surface of the address electrode lines $A_1, A_2, \ldots A_m$. The partition walls 17 are located on the front surface of the lower dielectric layer 15 parallel to the address electrode lines $A_1, A_2, \ldots A_m$. The partition walls 17 define discharge areas of the respective pixels and prevent optical crosstalk among pixels. The phosphor coating 16 are located between partition walls 17.

The X electrode lines $X_1, X_2, \ldots X_n$ and the Y electrode lines $Y_1, Y_2, \ldots Y_n$ are arranged on the rear surface of the front glass substrate 10 so as to be orthogonal to the address electrode lines $A_1, A_2, \ldots A_m$, in a predetermined pattern. The respective intersections define corresponding pixels. The X electrode lines $X_1, X_2, \ldots X_n$ and the Y electrode lines $Y_1, Y_2, \ldots Y_n$ each consist of transparent, conductive indium tin oxide (ITO) electrode lines ($X_{na}$ and $Y_{na}$ of FIG. 3) and metal bus electrode lines ($X_{nb}$ and $Y_{nb}$ of FIG. 3). The upper dielectric layer 11 entirely coats the rear surface of the X electrode lines $X_1, X_2, \ldots X_n$ and the Y electrode lines $Y_1, Y_2, \ldots Y_n$. The MgO protective film 12 for protecting the panel 1 against strong electrical fields entirely coats the rear surface of the upper dielectric layer 11. A gas for forming plasma is hermetically sealed in a discharge space 14.

The above-described plasma display panel is basically driven such that a reset step, an address step and a sustain-discharge step are sequentially performed in a unit subfield. In the reset step, wall charges remaining from the previous subfield are erased and space charges are evenly formed. In the address step, the wall charges are formed in a selected pixel area. Also, in the discharge-display step, light is produced at the pixel at which the wall charges are formed in the address step. In other words, if alternating pulses of a relatively high voltage are applied between the X electrode lines $X_1, X_2, \ldots X_n$ and the Y electrode lines $Y_1, Y_2, \ldots Y_n$, a surface discharge occurs at the pixels at which the wall charges are formed. Here, a plasma is formed in the gas in the discharge space 14 and phosphors 16 are excited by ultraviolet rays and emit light.

FIG. 4 shows the structure of a unit display period based on a driving method of a conventional plasma display panel.

Here, a unit display period represents a frame in the case of a progressive scanning method, and a field in the case of an interlaced scanning method. The driving method shown in FIG. 4 is generally referred to as a multiple address overlapping display driving method. According to this driving method, pulses for a display discharge are consistently applied to all X electrode lines ($X_1, X_2, \ldots X_n$ of FIG. 1) and all Y electrode lines ($Y_1, Y_2, \ldots Y_{480}$) and pulses for resetting or addressing are applied between the respective pulses for a display discharge. In other words, the reset and address steps are sequentially performed with respect to individual Y electrode lines or groups, within a unit subfield, and then the display discharge step is performed for the remaining time period. Thus, compared to an address-display separation driving method, the multiple address overlapping display driving method has an enhanced displayed luminance. Here, the address-display separation driving method refers to a method in which, within a unit subfield, reset and address steps are performed for all Y electrode lines $Y_1, Y_2, \ldots Y_{480}$, during a certain period and a display discharge step is then performed.

Referring to FIG. 4, a unit frame is divided into 8 subfields $SF_1, SF_2, \ldots SF_8$ for achieving a time-division gray scale display. In each subfield, reset, address and display discharge steps are performed, and the time allocated to each subfield is determined by a display discharge time. For example, in the case of displaying a 256 step scales with by 8-bit video data in the unit of frames, if a unit frame (generally 1/60 second) consists of 256 unit times, the first subfield $SF_1$, driven by the least significant bit (LSB) video data, has 1 ($2^0$) unit time, the second subfield $SF_2$ 2 ($2^1$) unit times, the third subfield $SF_3$ 4 ($2^2$) unit times, the fourth subfield $SF_4$ 8 ($2^3$) unit times, the fifth subfield $SF_5$ 16 ($2^4$) unit times, the sixth subfield $SF_6$ 32 ($2^5$) unit times, the seventh subfield $SF_7$ 64 ($2^6$) unit times, and the eighth subfield $SF_8$, driven by the most significant bit (MSB) video data, 128 ($2^6$) unit times. In other words, since the sum of unit times allocated to the respective subfields is 257 unit times, 255 steps can be displayed, 256 steps including one step which is not display-discharged at any subfield.

After the address step is performed and the display discharge step is then performed with respect to the first Y electrode line $Y_1$ or the first Y electrode line group, e.g., $Y_1$, $Y_2$, $Y_3$ and $Y_4$, in the first subfield $SF_1$, the address step is performed with respect to the first Y electrode line $Y_1$ or the first Y electrode line group, e.g., $Y_1$, $Y_2$, $Y_3$ and $Y_4$, in the second subfield $SF_2$. This procedure is applied to the subsequent subfields $SF_3, SF_4, \ldots SF_8$ in the same manner. For example, the address step is performed and the display discharge step is then performed with respect to the second Y electrode line $Y_2$ or the second Y electrode line group, e.g., $Y_5$, $Y_6$, $Y_7$ and $Y_8$, in the seventh subfield $SF_7$. Then, in the eighth subfield $SF_8$, the address electrode is performed and the display discharge step is then performed with respect to the second Y electrode line $Y_2$ or the second Y electrode line group, e.g., $Y_5$, $Y_6$, $Y_7$ and $Y_8$. The time for a unit subfield equals the time for a unit frame. The respective subfields overlap on the basis of the driven Y electrode lines $Y_1, Y_2, \ldots Y_{480}$, to form a unit frame. Thus, since all subfields $SF_1, SF_2, \ldots SF_8$ exist in every timing, time slots for addressing depending on the number of subfields are set between pulses for display discharging, for the purpose of performing the respective address steps.

According to the above-described driving method, conventionally, the widths of scan pulses applied to the address electrode lines selected corresponding to the respective scanned Y electrode lines and the widths of the pulses of the corresponding display data signals have been fixed. However, the times required for wall charges formed on the respective Y electrode lines due to addressing to wait for the pulse for the first display discharge (2 in the period $T_{31}$ or $T_{41}$ of FIG. 5) are different. As the times become longer, more wall charges formed at the pixels to be displayed are removed. Thus, according to the conventional driving method, it is highly probable that pixels to be displayed are not consistently displayed at subfields scanned first, e.g., $SF_1$ and $SF_5$, among subfields, which lowers the displaying uniformity and stability.

SUMMARY OF THE INVENTION

To solve the above problem, it is an object of the present invention to provide a method for driving a plasma display panel which can enhance the displaying uniformity and stability by preventing a phenomenon in which a display discharge does not occur at to-be-displayed pixels of a specific subfield.

To achieve the above object, there is provided a method for driving a plasma display panel having front and rear substrates opposed to and facing each other, X and Y electrode lines formed between the front and rear substrates to be parallel to each other and address electrode lines formed to be orthogonal to the X and Y electrode lines, to define corresponding pixels at interconnections, such that a scan pulse is applied to the respective Y electrode lines with a predetermined time difference and the corresponding display data signals are simultaneously applied to the respective address electrode lines to form wall charges at pixels to be displayed, pulses for a display discharge are alternately applied to the X and Y electrode lines to cause a display discharge at the pixels where the wall charges have been formed, the driving method wherein as a time difference between the first pulse among pulses for display discharges and the pulses of display data signals applied to pixels to be displayed before application of the first pulse becomes larger, the widths of the pulses of display data signals applied to pixels to be displayed and the corresponding scan pulses are increased.

Accordingly, since a difference between the quantities of wall charges caused by a difference in the application order of scan pulses to the Y electrode lines of the respective subfields can be compensated for by a difference between the widths of the pulses of the display data signals and the corresponding scan pulses, the displaying uniformity and stability can be enhanced.

BRIEF DESCRIPTION OF THE DRAWINGS

The above objects and advantages of the present invention will become more apparent by describing in detail a preferred embodiment thereof with reference to the attached drawings in which.

DESCRIPTION OF THE PREFERRED EMBODIMENT

Figure 1:
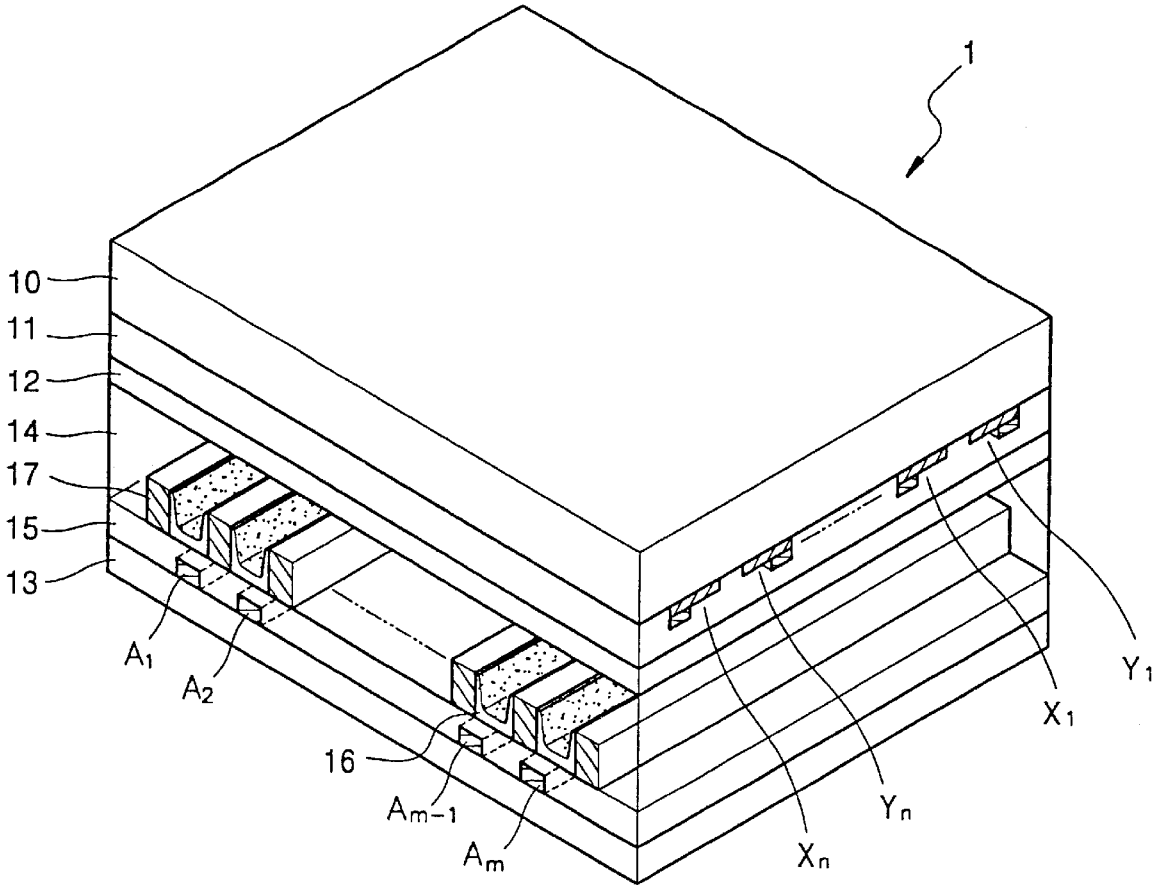
FIG. 1 PRIOR ART
FIG. 1 shows an internal perspective view illustrating the structure of a general three-electrode surface-discharge plasma display panel.
Figure 2:
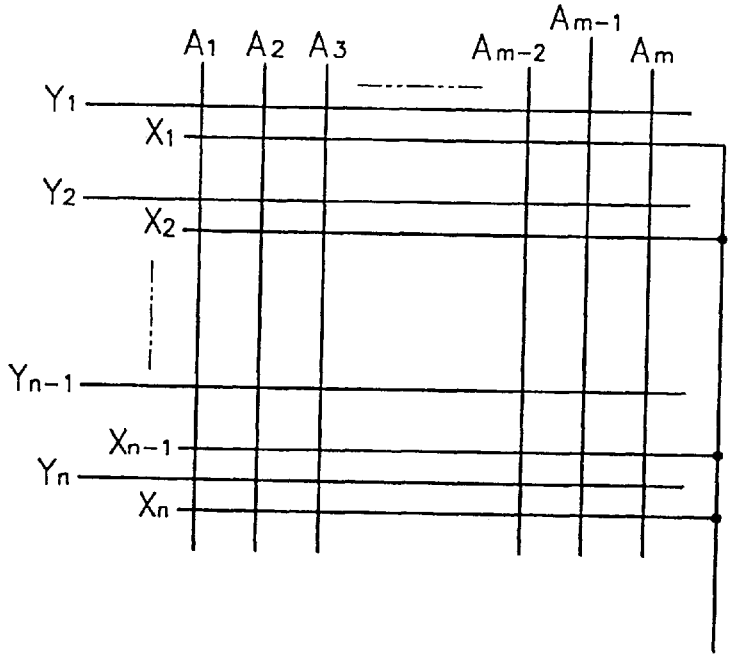
FIG. 2 PRIOR ART
FIG. 2 shows an electrode line pattern of the panel shown in FIG. 1.
Figure 3:
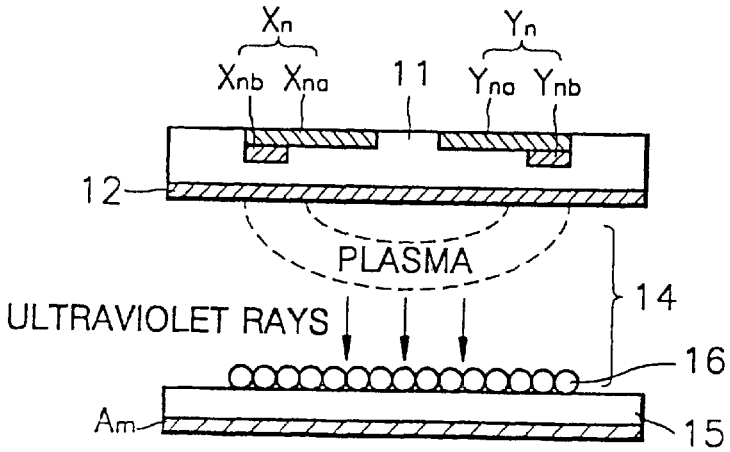
FIG. 3 PRIOR ART
FIG. 3 is a cross section of an example of a pixel of the panel shown in FIG. 1.
Figure 4:
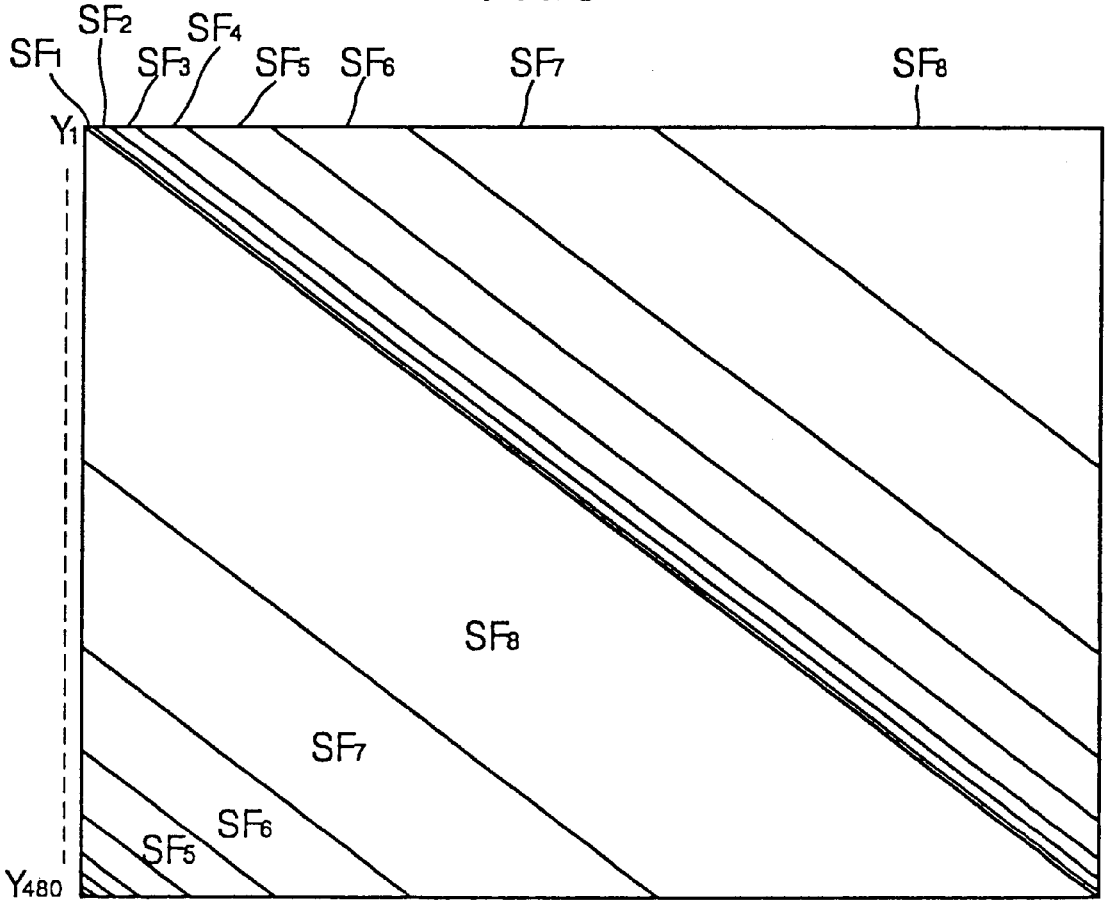
FIG. 4 PRIOR ART
FIG. 4 is a timing diagram showing the format of a unit display period based on a general method for driving a plasma display panel.
Figure 5:
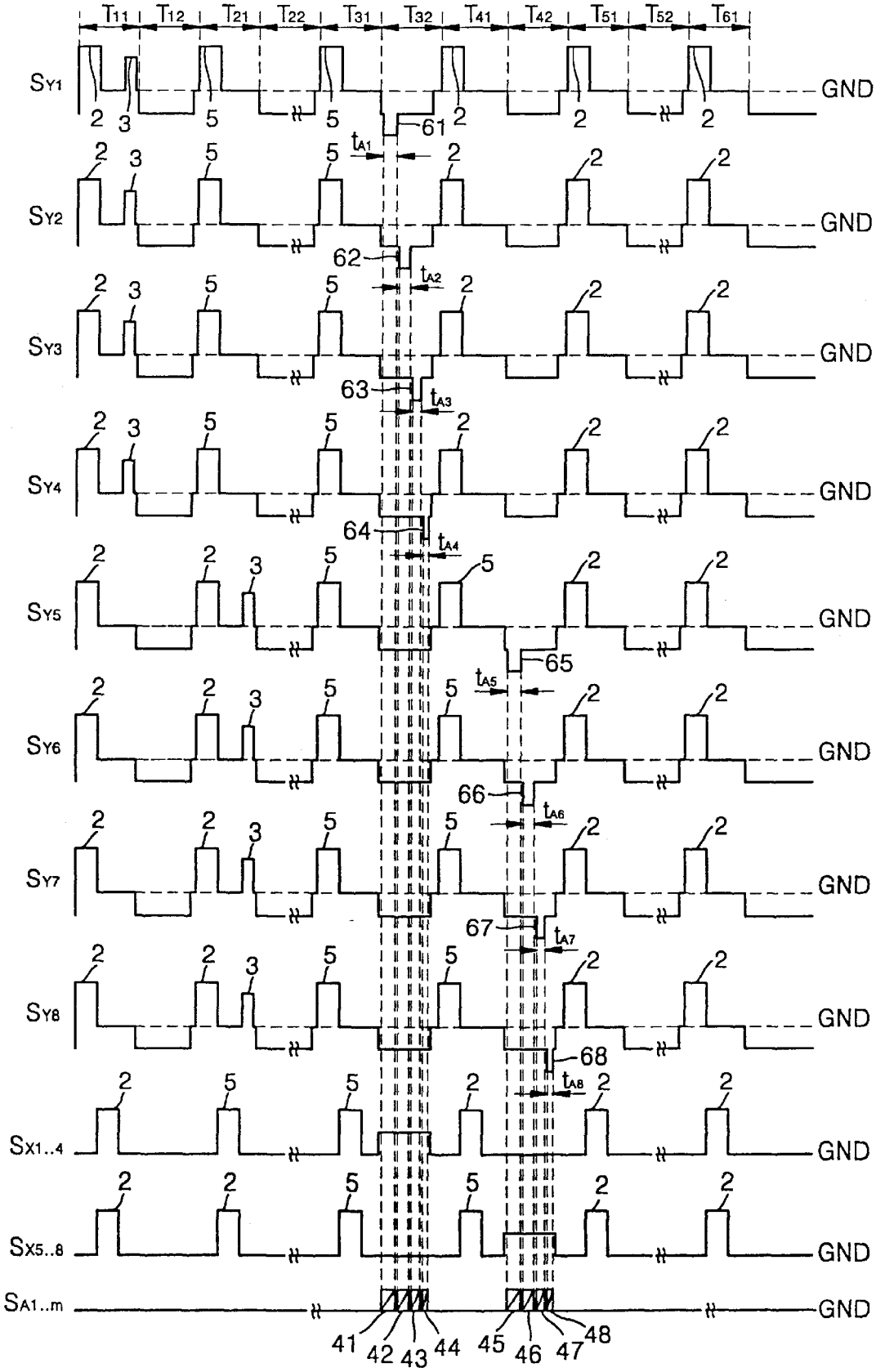
FIG. 5 is a voltage waveform diagram of driving signals in a unit display period based on a method for driving a plasma display panel according to the present invention.
Figure 6:
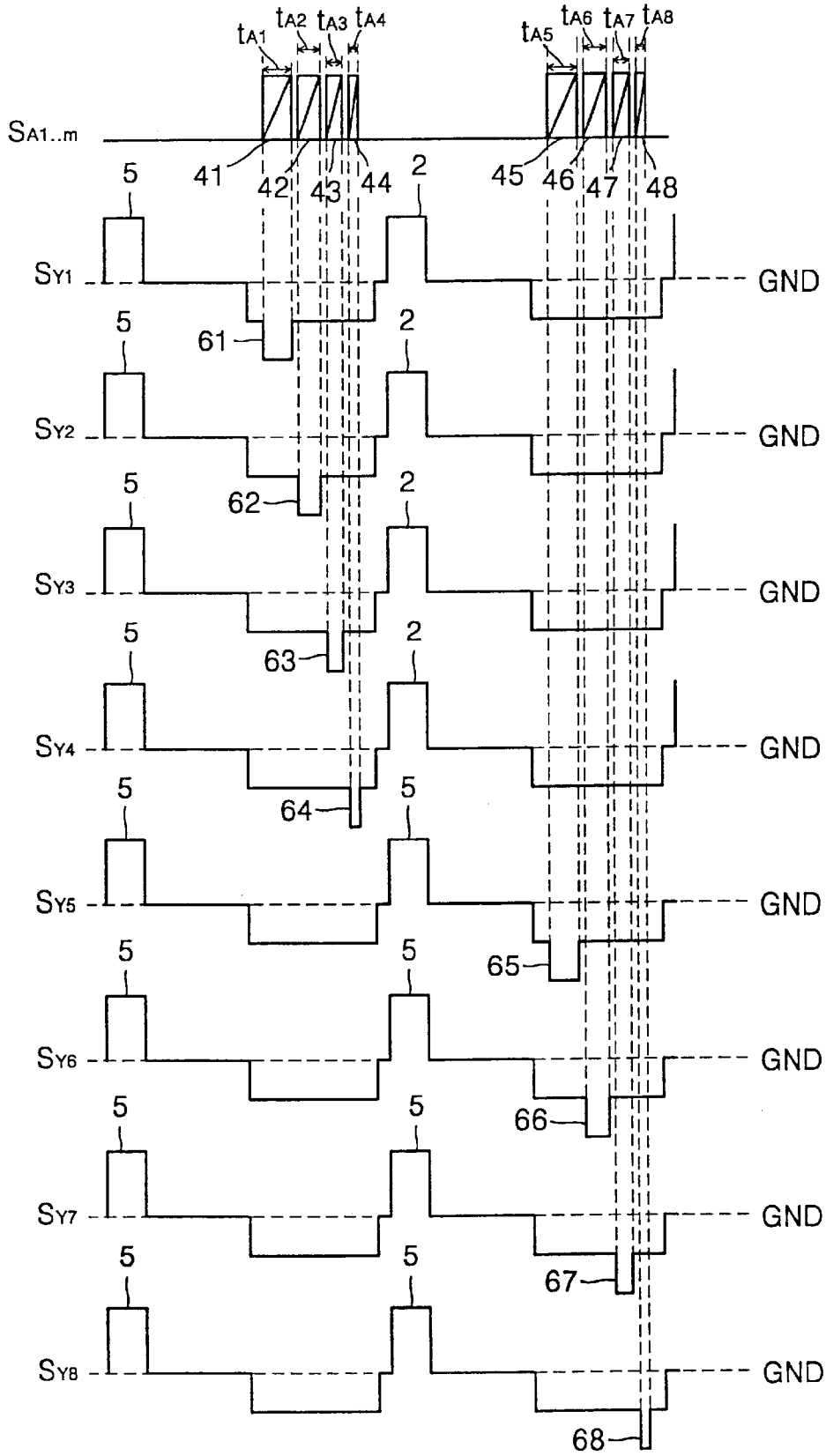
FIG. 6 is a detailed voltage waveform diagram of driving signals applied to the Y and X electrode lines corresponding to the respective subfields in periods $T_{31}$, to $T_{42}$ of FIG. 5.

FIG. 5 shows driving signals in a unit subfield based on a driving method according to the present invention. In FIG. 5, reference marks $S_{Y1}$, $S_{Y2}$, . . . $S_{Y8}$ denote driving signals applied to the Y electrode lines corresponding to the respective subfields. In more detail, $S_{Y1}$, denotes a driving signal applied to Y electrode lines of a first subfield ($SF_1$ of FIG. 4), $S_{Y2}$ denotes a driving signal applied to Y electrode lines of a second subfield ($SF_2$ of FIG. 4), $S_{Y3}$ denotes a driving signal applied to Y electrode lines of a third subfield ($SF_3$ of FIG. 4), $S_{Y4}$ denotes a driving signal applied to Y electrode lines of a fourth subfield ($SF_4$ of FIG. 4), $S_{Y5}$ denotes a driving signal applied to Y electrode lines of a fifth subfield ($SF_5$ of FIG. 4), $S_{Y6}$ denotes a driving signal applied to Y electrode lines of a sixth subfield ($SF_6$ of FIG. 4), $S_{Y7}$ denotes a driving signal applied to Y electrode lines of a seventh subfield ($SF_7$ of FIG. 4), and $S_{Y8}$ denotes a driving signal applied to Y electrode lines of an eighth subfield ($SF_8$ of FIG. 4), respectively. Reference marks $S_{X1..4}$ and $S_{X5..8}$ denote driving signals applied to the X electrode line groups corresponding to the Y electrode lines, $S_{A1..m}$ denotes display data signals applied to all address electrode lines ($A_1$, $A_2$, . . . $A_m$ of FIG. 1), reference numerals 41, 42, . . . 48 denote pulses of display data signals applied to pixels to be displayed, 61, 62, . . .. 68 denote scan pulses, and GND denotes a ground voltage. FIG. 6 is a detailed voltage waveform diagram of driving signals applied to the Y and X electrode lines corresponding to the respective subfields in periods $T_{31}$ to $T_{42}$ of FIG. 5.

Referring to FIGS. 5 and 6, as a time difference between the first pulse 2 among pulses for display discharges and the pulses 41, 42, . . . 48 of display data signals applied to pixels for a displayed discharge before application of the first pulse 2 becomes larger, the widths $t_{A1}$, $t_{A2}$, . . . $t_{A8}$ of the pulses 41, 42, . . . 48 of display data signals applied to pixels to be displayed and the corresponding scan pulses 61, 62, . . . 68 are increased. In more detail, the first addressing times $t_{A1}$, and $t_{A5}$ corresponding to the Y electrode lines of the first and fifth subfields are the longest, the second addressing times $t_{A2}$ and $t_{A6}$ corresponding to the Y electrode lines of the second and sixth subfields are the second longest, the third addressing times $t_{A3}$ and $t_{A7}$ corresponding to the Y electrode lines of the third and seventh subfields are the third longest, and the last addressing times $t_{A4}$ and $t_{A8}$ corresponding to the Y electrode lines of the fourth and eighth subfields are the shortest.

The above-described conditions for controlling timings can be expressed in formula (1).

[Formula (1)]

$$(t_{A1}=t_{A5})>(t_{A2}=t_{A6})>(t_{A3}=t_{A7})>(t_{A4}=t_{A8})$$

Accordingly, a difference between the quantities of wall charges caused by a difference in the application order of scan pulses to the Y electrode lines of the respective subfields can be compensated for by a difference between the widths of the pulses 41, 42, . . . 48 of the display data signals and the corresponding scan pulses 61, 62, . . . 68.

The pulses 2 and 5 for display discharges are consistently applied to the X electrode lines ($X_1$, $X_2$, . . .. $X_n$ of FIG. 1) and all Y electrode lines $Y_1$, $Y_2$, . . . $Y_{480}$, and a reset pulse 3 or scan pulse 6 is applied between the pulses 2 and 5 for display discharges. Here, resetting or addressing pulses are applied to the Y electrode lines corresponding to a plurality of subfields $SF_1$, $SF_2$, . . . $SF_8$.

There exists a predetermined quiescent period until the scan pulse 6 is applied since the reset pulse 3 was applied, so that space charges are smoothly distributed at the corresponding pixel areas. In FIG. 5, time periods $T_{12}$, $T_{21}$, $T_{22}$ and $T_{31}$, denote quiescent periods corresponding to Y electrode line groups of the first through fourth subfields, and time periods $T_{22}$, $T_{31}$, $T_{32}$ and $T_{41}$, denote quiescent periods corresponding to Y electrode line groups of the fifth through eighth subfields. The pulses 5 for a display discharge applied during the respective quiescent periods cannot actually cause a display discharge but allow space charges to be smoothly distributed at the corresponding pixel areas. However, the pulses 2 for a display discharge applied during periods other than the quiescent periods cause a display discharge at the pixels where wall charges have been formed by the scan pulse 6 and the display data signal $S_{A1...m}$.

Between the last pulses, among the pulses 5 for a display discharge applied during the quiescent periods, and the first pulses 2 for a display discharge, subsequent to the last pulses, that is, $T_{32}$ or $T_{42}$, addressing is performed four times. For example, addressing is performed for the Y electrode line group corresponding to the first through fourth subfields during a time period $T_{32}$. Also, addressing is performed for the Y electrode line group corresponding to the fifth through eighth subfields during a time period $T_{42}$. As described above with reference to FIG. 4, since all subfields $SF_1$, $SF_2$, . . . $SF_8$ exist at every timing, time slots for addressing, depending on the number of subfields are set between the respective pulses for a display discharge for the purpose of performing the respective address steps.

After the pulses 2 and 5 for display discharges simultaneously applied to the Y electrode lines $Y_1$, $Y_2$, . . . $Y_{480}$, terminate, the pulses 2 and 5 for display discharges simultaneously applied to the X electrode lines $X_1$, $X_2$, . . . $X_n$ start to occur. The scan pulses 6 and the corresponding display data signals are applied after the pulses 2 and 5 for display discharges simultaneously applied to the X electrode lines $X_1$, $X_2$, . . . $X_n$ terminate and before the pulses 2 and 5 for display discharges simultaneously applied to the Y electrode lines $Y_1$, $Y_2$, . . . $Y_{480}$ start.

As described above, in the method for driving a plasma display panel according to the present invention, since a difference between the quantities of wall charges caused by a difference in the application order of scan pulses to the Y electrode lines of the respective subfields can be compensated for by a difference between the widths of the pulses of the display data signals and the corresponding scan pulses, the displaying uniformity and stability can be enhanced.

Although the invention has been described with respect to a preferred embodiment, it is not to be so limited as changes and modifications can be made which are within the full intended scope of the invention as defined by the appended claims.

What is claimed is:

1. A method for driving a plasma display panel having front and rear substrates opposed to and facing each other, X and Y electrode lines between the front and rear substrates and parallel to each other, and address electrode lines orthogonal to the X and Y electrode lines, to define corresponding pixels at intersections, the method comprising applying scan pulses to respective groups of Y electrode lines with a time difference and simultaneously applying corresponding display data signals to respective address electrode lines to form wall charges at pixels where a display discharge is to occur, and alternately applying pulses for a display discharge to the X and Y electrode lines to cause a display discharge at the pixels where wall charges have been formed, wherein, as a time difference between (i) a first pulse of the pulses for display discharges, and (ii) pulses of the display data signals applied to pixels for a display discharge before application of the first pulse becomes larger, widths of the pulses of the display data signals applied to pixels where a display discharge is to occur and of corresponding scan pulses are increased.

* * * * *